US010722082B2

(12) United States Patent
Dansreau et al.

(10) Patent No.: US 10,722,082 B2
(45) Date of Patent: Jul. 28, 2020

(54) DIAPHRAGM FOR A CONTAINER ASSEMBLY

(71) Applicant: Edgewell Personal Care Brands, LLC., Chesterfield, MO (US)

(72) Inventors: Paul Dansreau, Shelton, CT (US); Stephan Fischer, Solingen (DE); Narada Howard, Lyndhurst, NJ (US); Thorsten Reich, Solingen (DE); Ellen Rinaldi, Bethel, CT (US)

(73) Assignee: EDGEWELL PERSONAL CARE BRANDS, LLC, Chesterfield ( * ) Notice: Subject to any disclaimer, the term of this patent is extended or adjusted under 35 U.S.C. 154(b) by 0 days.

(21) Appl. No.: 15/676,004

(22) Filed: Aug. 14, 2017

(65) Prior Publication Data

US 2018/0042432 A1 Feb. 15, 2018

Related U.S. Application Data

(60) Provisional application No. 62/374,064, filed on Aug. 12, 2016.

(51) Int. Cl.
*A47K 10/38* (2006.01)
*A47K 10/32* (2006.01)

(52) U.S. Cl.
CPC .. *A47K 10/3818* (2013.01); *A47K 2010/3266* (2013.01)

(58) Field of Classification Search
CPC ..... A47K 10/3818; A47K 2010/3266
USPC ..... 221/63, 48, 47, 45, 46, 283, 197; 206/233, 494, 440, 497; 229/232, 191, 229/229
See application file for complete search history.

(56) References Cited

U.S. PATENT DOCUMENTS 2,004,614 A * 6/1935 Meagher ..... A47K 10/3818 206/63.5
3,986,479 A * 10/1976 Bonk ..... B65D 83/0805 118/506
4,017,002 A * 4/1977 Doyle ..... A47K 10/3818 221/63
4,534,491 A * 8/1985 Norton ..... A47K 10/3818 221/310
4,785,970 A * 11/1988 Engelmayer ..... B65D 83/0805 221/47
5,219,421 A * 6/1993 Tipping ..... B65D 83/0805 206/233
5,316,177 A * 5/1994 Boldt ..... B65D 83/0805 206/233
5,325,992 A * 7/1994 Koller ..... A47F 13/085 221/33
5,415,320 A * 5/1995 North ..... A47K 10/42 206/233

(Continued)

*Primary Examiner* — Rakesh Kumar

(57) ABSTRACT

A diaphragm for a container assembly for dispensing products such as wipes or sheets, or collecting and/or storing products, including waste products. The container assembly has diaphragm with a central aperture and at least one petal. The diaphragm is a portion of the lid or the container. The aperture allows a user to insert one or more fingers (or hand) to pull the first sheet out or alternatively, deposit an item into the container. The diaphragm has one or more slits separating the outer periphery of the diaphragm from portions of the petals, thereby reducing the force required to deflect the diaphragm.

19 Claims, 16 Drawing Sheets

(56) References Cited

U.S. PATENT DOCUMENTS 5,467,893 A * 11/1995 Landis, II ..... A47K 10/3818 206/210
5,718,353 A * 2/1998 Kanfer ..... A47K 10/3818 221/63
5,908,138 A * 6/1999 Vlahakis ..... B65D 83/0805 206/409
6,056,235 A * 5/2000 Brozinsky ..... A47K 10/32 242/598.6
6,189,730 B1 * 2/2001 McClymonds .... A47K 10/3818 221/197
6,279,775 B1 * 8/2001 Parkes ..... A47K 10/3818 221/185
6,318,590 B1 * 11/2001 McMurray-Stivers ..... A47K 10/3818 221/281
6,523,690 B1 * 2/2003 Buck ..... A47K 10/421 206/494
6,550,633 B2 * 4/2003 Huang ..... A47K 10/42 221/45
6,604,651 B2 * 8/2003 Amundson ..... B65D 33/2591 206/233
6,758,368 B2 * 7/2004 Sarbo ..... B65D 83/0805 221/47
6,840,401 B2 * 1/2005 Amundson ..... B65D 83/0805 206/494
6,889,867 B1 * 5/2005 Smith ..... B65D 43/0212 221/306
6,945,424 B1 * 9/2005 Gardner ..... B65B 27/083 100/34
7,204,450 B1 * 4/2007 Mallory ..... B65H 55/043 206/390
7,380,687 B2 * 6/2008 FitzSimons ..... A47K 10/38 221/199
7,559,434 B2 * 7/2009 Masting ..... A47K 10/3809 221/34
7,597,213 B2 * 10/2009 McDonald ..... B65D 83/0805 220/229
7,699,214 B2 * 4/2010 Mestre ..... B65D 5/606 206/233
9,487,340 B2 * 11/2016 Castela ..... B65D 83/0805
9,549,646 B2 * 1/2017 Ray ..... B65D 83/0805
9,694,554 B2 * 7/2017 Mulvey ..... B31D 5/0043
2002/0096534 A1 * 7/2002 Amundson ..... B65D 33/2591 221/63
2003/0015543 A1 * 1/2003 Turbett ..... A47K 10/424 221/63
2003/0146231 A1 * 8/2003 Sarbo ..... B65D 83/0894 221/63
2008/0314920 A1 * 12/2008 Rodrigues ..... A61B 42/40 221/63

* cited by examiner

DIAPHRAGM FOR A CONTAINER ASSEMBLY

CROSS-REFERENCE TO RELATED APPLICATIONS

This application claims priority to U.S. Provisional Patent Application Ser. No. 62/374,064, the contents of which are incorporated in its entirety herein.

FIELD OF THE INVENTION

A container for dispensing treated sheets for various uses is presented. The container includes a lid having an aperture providing a user with a way to pull one sheet at a time from the container.

BACKGROUND OF THE INVENTION

This section is intended to provide a background or context. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Previous containers have included a lid having an aperture for dispensing a product inside one sheet at a time while positioning a next sheet for subsequent removal. Unfortunately, sometimes those sheets fail to properly position the next sheet so consumers can easily remove that sheet. Correspondingly, previous container lids have received consumer complaints related to the design of the aperture. For example, users have complained that it can be difficult to thread and/or remove wipes through a crosshair aperture in container lids and sometimes their fingers get caught in the crosshairs of the aperture while trying to position or retrieve the next sheet of product.

SUMMARY OF THE INVENTION

The below summary section is intended to be merely exemplary and non-limiting.

The foregoing and other problems are overcome, and other advantages are realized, by the use of the exemplary embodiments set forth below.

An aperture is configured to dispense sheet material from a container. The terms "container" and "canister" are interchangeable as used throughout the present disclosure. The aperture is formed in part of the container and includes a diaphragm, the diaphragm having intersecting substantially linear slits formed in the diaphragm and thus forming a plurality of petals in the diaphragm where the slits intersect. The aperture, further including at least one opening in the diaphragm located adjacent a peripheral portion of the diaphragm, and is intersected by at least one of the substantially linear slits, thereby increasing the flexibility of at least one of the petals by reducing a length of edge thereof supported by the peripheral portion of the diaphragm, thereby allowing substantially one sheet at a time to be pulled from the container.

The aperture is formed in part of the container or canister, such as the lid, and includes a diaphragm portion. The aperture includes intersecting substantially linear slits formed in the diaphragm thereby forming a plurality of petals in the diaphragm. Where the linear slits are positioned, in some embodiments, the aperture further includes at least one additional slit or other opening in the diaphragm. The at least one additional slit is located adjacent a peripheral portion of the diaphragm and is intersected by at least one of the linear slits. Thereby increasing the flexibility of at least one of the petals by reducing a length of edge thereof supported by the peripheral portion of the diaphragm, thereby allowing substantially one sheet at a time to be pulled from the container.

The aperture is formed in part of the container and includes a diaphragm portion, the diaphragm having substantially linear slits intersecting each other and formed in the diaphragm thereby forming a plurality of petals in the diaphragm where the slits intersect.

The aperture, in some embodiments, further including at least one opening in the diaphragm located adjacent a peripheral portion of the diaphragm, and is intersected by at least one of the substantially linear slits, thereby increasing the flexibility of at least one of the petals by reducing a length of edge thereof supported by the peripheral portion of the diaphragm, thereby allowing substantially one sheet at a time to be pulled from the container.

BRIEF DESCRIPTION OF THE DRAWING

A more complete appreciation of the present disclosure and many of the attendant advantages thereof will be readily obtained as the same becomes better understood by reference to the following detailed description when considered in connection with the accompanying drawings. The foregoing and other aspects of exemplary embodiments are made more evident in the following Detailed Description, when read in conjunction with the attached Drawing Figures, wherein.

DETAILED DESCRIPTION

Figure 1A:
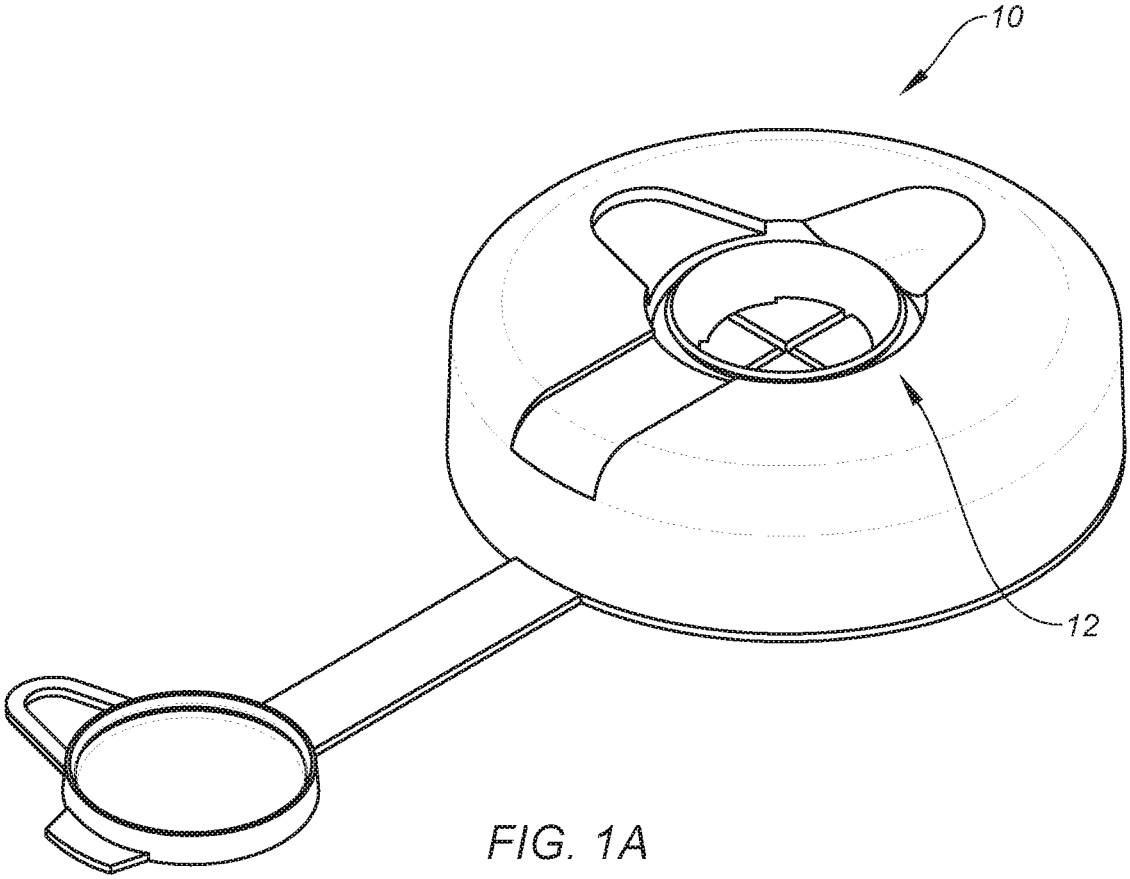
FIG. 1A is a perspective view showing an outside view of a dispenser lid with a dispensing aperture.

Various non-limiting embodiments of the present disclosure will now be described to provide an overall understanding of the principles of the structure, function, and use of the canister lid disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Described herein are example embodiments of a canister lid for dispensing sheets such as cleaning wipes. The examples discussed herein are intended to be illustrative only to assist in explanation of the apparatuses, devices, systems and methods described. Features or components shown in the drawings or discussed below should not be taken as mandatory for any specific implementation of any of these the apparatuses, devices, systems or methods unless specifically designated as mandatory. For ease of reading and clarity, certain components, modules, or methods may be described solely in connection with a specific figure. Any failure to specifically describe a combination or sub-combination of components should not be understood as an indication that any combination or sub-combination is not envisioned.

Figure 1B:
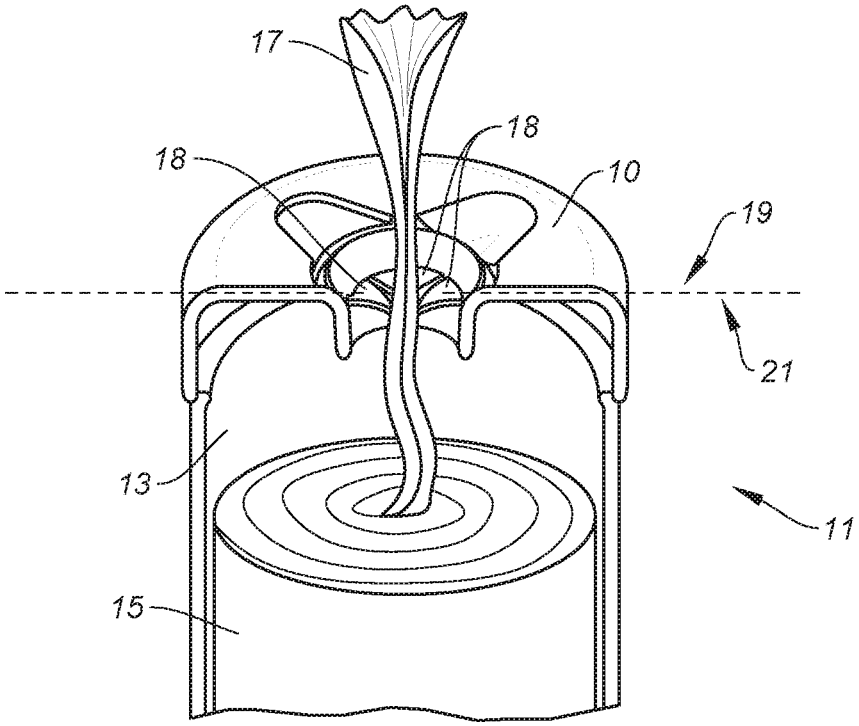
FIG. 1B is a cut-away perspective view showing the canister assembly of the present disclosure.

As shown in FIG. 1A, a canister lid 10 includes an aperture 12 configured to dispense sheet material from within a container or canister (not shown). While the aperture 12 is formed in the canister lid 10, it could be formed as part of the container forming the canister. FIG. 1B exemplifies an embodiment of the present disclosure with a cut-away view of a canister assembly 11. Canister assembly 11 has a canister lid 10 and a container 13. Canister assembly 11 is shown having at least one product 15 (i.e. a roll of wipes) at least partially within container 13. Canister assembly 11 further exemplifies a non-limiting example where product 15 being prepped for use (i.e. dispensing), where product 15 is a wipe 17. Wipe 17 is shown such that at least a portion of wipe 17 is above a top surface 19 of canister lid 10, and more specifically, a top 19 surface of petals 18 and diaphragm 14. Wipe 17 is also shown such that a portion of wipe 17 is below a bottom surface 21 of canister lid 10, and more specifically, a bottom surface 21 of petals 18 and diaphragm 14.

Figure 2A:
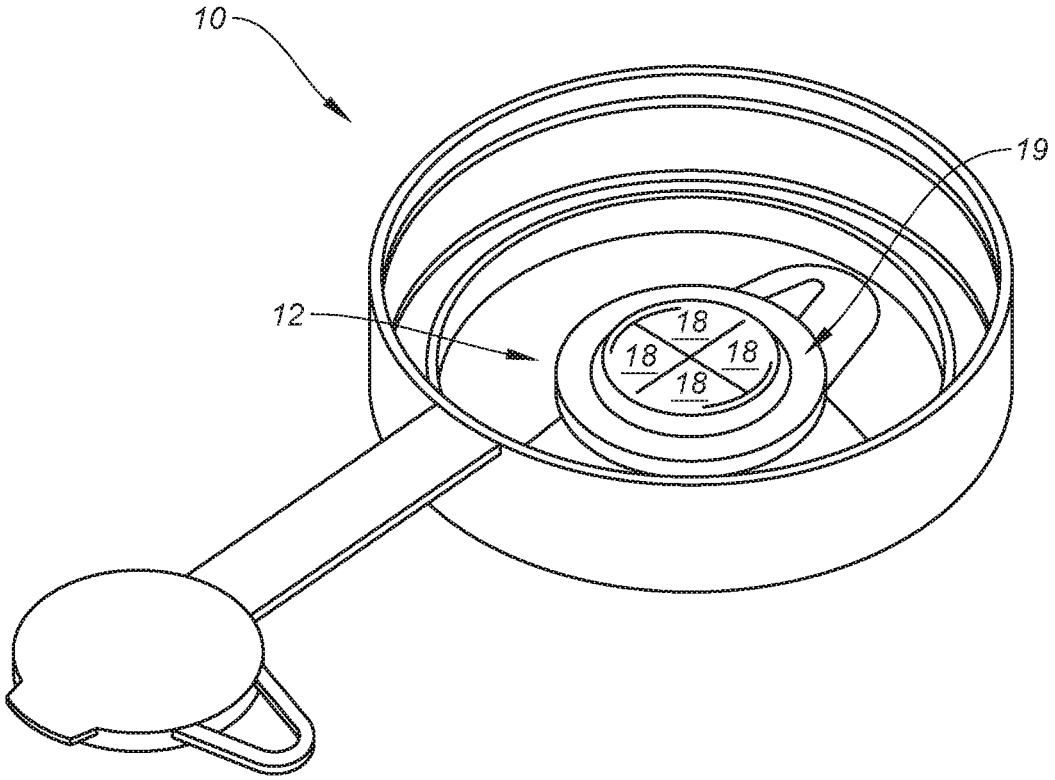
FIG. 2A is a perspective view similar to FIG. 1 showing an inside view of a dispenser lid.
Figure 2B:
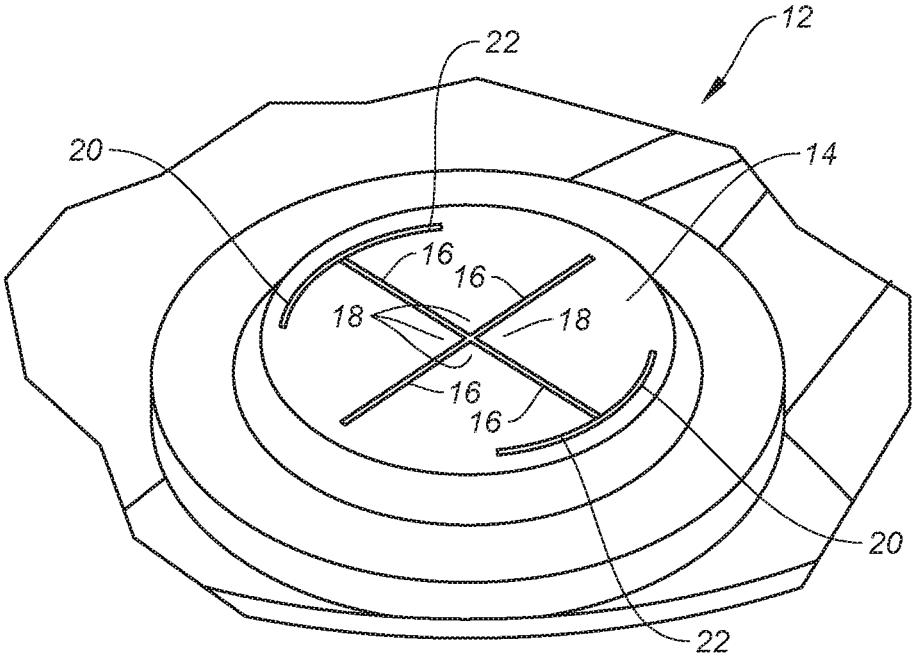
FIG. 2B is an enlarged sectional view of the dispensing aperture of FIG. 2A.

FIG. 2A shows the inside of canister lid 10. Referring to FIG. 2B, the aperture 12 includes a diaphragm 14, the diaphragm 14 includes intersecting substantially linear slits 16 formed in the diaphragm 14 thereby forming a plurality of petals 18 in the diaphragm 14 where the slits 16 intersect. Diaphragm 14 is generally composed of a pliable or flexible material that can vary in stiffness according to the sheet material being dispensed. In some embodiments the diaphragm is made of a polymer such as polyethylene, vinyl, polyvinyl chloride (PVC), polypropylene, polyester, ABS, elastomeric materials such as thermoplastic elastomers, rubber, films, laminates, combinations of materials, etc. . . . In some embodiments the lid and diaphragm are made of a single piece of plastic. In some embodiments the diaphragm 14 includes intersecting substantially linear slits 16 disposed substantially 90 degrees apart.

Each petal 18 has a tip region 50 distal to a base region 56, a center region 58 between the tip region 50 and base region 56. The tip regions 50 cooperate to define the aperture 12 towards a central portion 60 of the diaphragm 14. Each petal 18 has a base region 56 at least partially connected to the diaphragm 14. In some embodiments, the base region 56 is at least partially connected to an outer perimeter 62 of the diaphragm 14. The aperture 12 has a first state wherein each tip region 50 is substantially parallel to a horizontal axis, and a second state wherein the petals 18 are other than parallel to the horizontal axis, and a third state wherein the petals 18 are either substantially parallel and/or other than parallel. For example, in some embodiments, the aperture 12 has a first at-rest state, a second deflected state, and a third modified state. The aperture 12, in the first state, does not contain a product or finger in the aperture 12, e.g. only air. The aperture 12, in the second state, contains at least one finger, or said differently, the at least one finger passes through the aperture 12, perhaps deflecting at least one petal 18, and thereafter pulls a product 15 through the aperture 12. The aperture 12, in the third state, contains at least a portion of the product 15 such that the product is prepped for a down-turn use by the consumer. Said differently, the product 15 is grasped by at least one petal 18 and maintained in the aperture 12 such that at least a portion of the product 15 is above a top surface 19 of the at least one petal 18 and a portion of the product is below a bottom surface 21 of the at least one petal 18. Preferably, the product 15 is substantially contained below the bottom surface 21 of the at least one petal 18 such that the product 15 is maintained in a protected state within the container body. Also preferably, the product 15 has a portion above the top surface 19 of the at least one petal such that it is easily grasped by the consumer for complete removal from the canister lid 10, canister 13 and/or container assembly 11 in general.

The diaphragm 14 is made of a deflectable material wherein the aperture 12 has a larger size in the second state than in the first state. As described herein, in some embodiments, the base region of at least one of the petals 18 includes a substantially arcuate slit to facilitate deflection of the diaphragm 14. As described herein, in some embodiments, the tip region 50 includes a bubble or rounded coatings for separating a product or finger in the aperture 12 from making direct contact with a tip in the tip region 50. As described herein, in some embodiments, the tip region 50 includes a rounded tip.

Although embodiments represented by the figures generally provide a diaphragm 14 having four petals 18 divided by two slits 16, other embodiments of the present invention include at least two petals 18 and up to eight petals 18, and/or between one and eight slits 16 that are substantially linear and/or non-linear, where each slit 16 provides at least partial separation between two petals 18. Size, number and configuration of slits 16 petals 18 are configured with respect to the contents being at least partially contained by canister lid 10 and/or being dispensed through such diaphragm 14.

In some embodiments an opening 20 affects the rigidity of the diaphragm 14 reducing the force on a user's finger when inserted through aperture 12 to pull the first sheet of product 15 such as a first wipe 17 outwardly through the aperture 12. In other embodiments, the diaphragm 14 is configured to enable at least a portion of a user's hand, such as a finger, to slip through the diaphragm 14 having an aperture 12 to either place an, item into canister 13 and/or withdraw an item (such as a wipe 17) from canister 13. As shown in FIG. 2B, the opening 20 is sized and shaped to be an additional slit 22. In a preferred embodiment, the additional slit 22 is arcuate in shape. It is preferable to have two additional slits 22 formed at or near the ends of one of the slits 22. The additional slits 22 can coincide with the arc of the diaphragm 14 when the diaphragm 14 is circular in shape. The additional slits 22 act to increase the flexibility of the diaphragm 14. The aperture 12, further includes at least one opening 20 in the diaphragm 14 located adjacent a peripheral portion 34 of the diaphragm 14, and is intersected by at least one of the substantially linear slits 16, thereby increasing the flexibility of at least one of the petals 18 by reducing a length of edge thereof supported by the peripheral portion 34 of the diaphragm 14, thereby allowing substantially one sheet at a time to be pulled from the container. In some embodiments, the number of slits 22 is between one and eight, depending on the number of petals 18, slits 16, and/or the contents being at least partially contained by canister lid 10 and/or being dispensed through such diaphragm 14.

Figure 3:
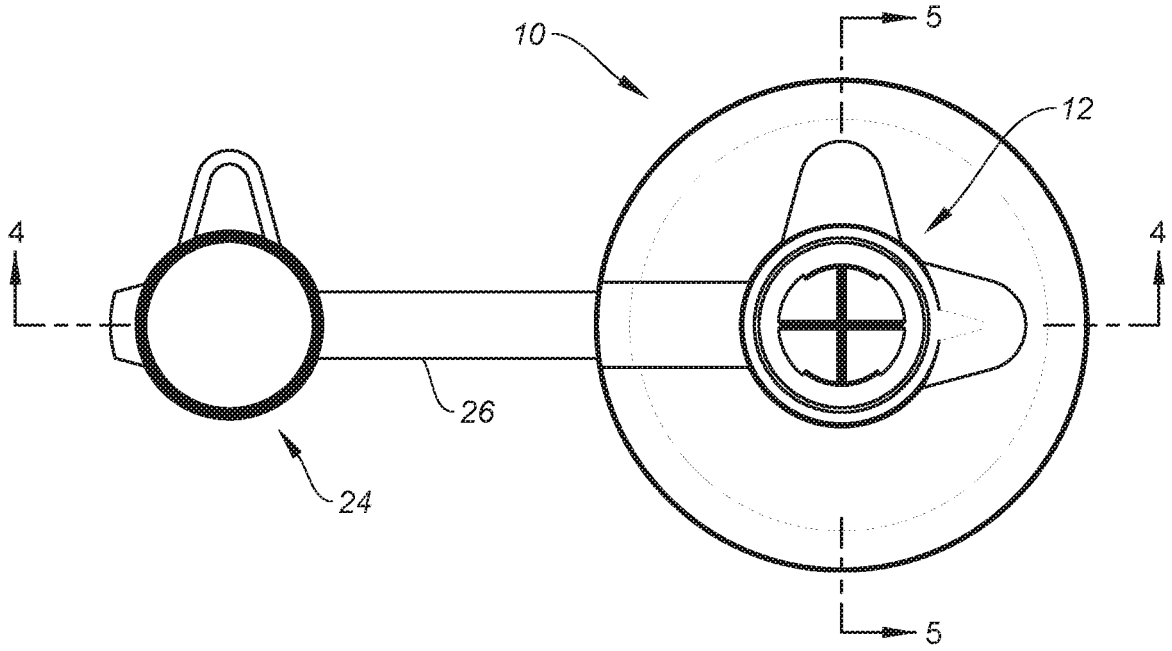
FIG. 3 is a top view of the outside of the dispenser lid.

Referring now to FIG. 3, the outside of the canister lid 10 is shown. As is generally the case, the aperture 12 is centrally located on the lid 10. Also shown in FIG. 3 is a cap 24 for sealing the aperture 12, to mitigate against evaporation and other potentially deleterious impact(s) from the external environment. In some embodiments the cap 24 has a snap fit with the aperture 12 such that cap 24 substantially covers aperture 12. Cap 24 may include a strap 26 to retain the cap 24 to the canister lid 10. In some embodiments, strap 26 is integral with cap 24 and/or canister lid 10. In other embodiments, strap 26 is connectable to cap 24 and canister lid 10.

Figure 4:
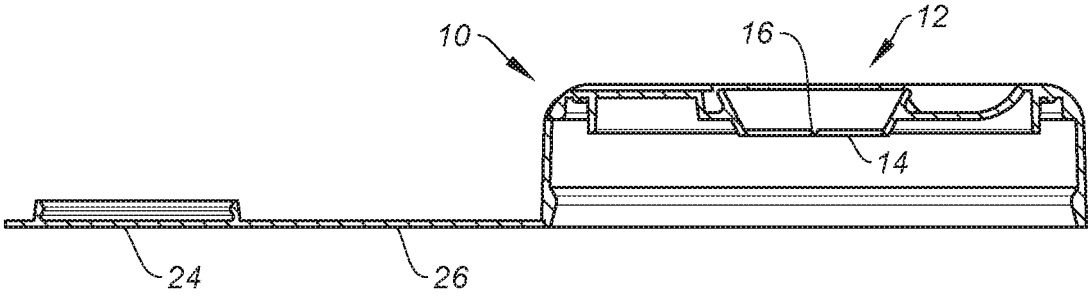
FIG. 4 is a cross-sectional view of FIG. 3 taken along lines 4-4.

As shown in FIG. 4, the canister cap 10, the cap 24, and the strap 26 are made from relatively thin material. The aperture 12 is shown in cross section including the diaphragm 14.

Figure 5A:
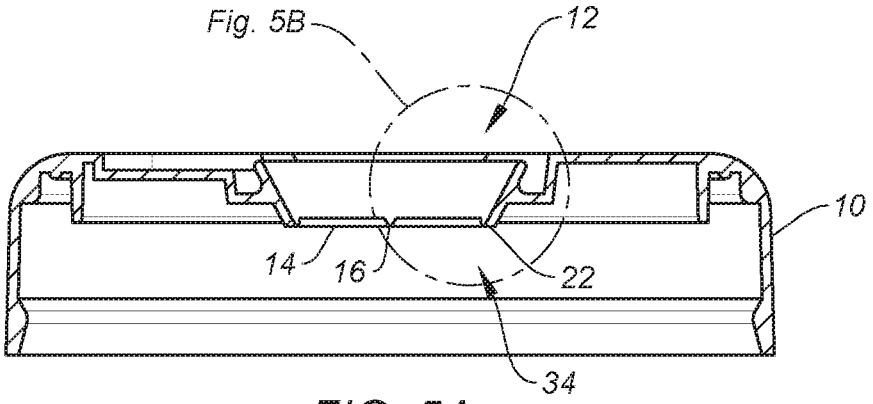
FIG. 5A is a cross-sectional view of FIG. 3 taken along lines 5-5.
Figure 5B:
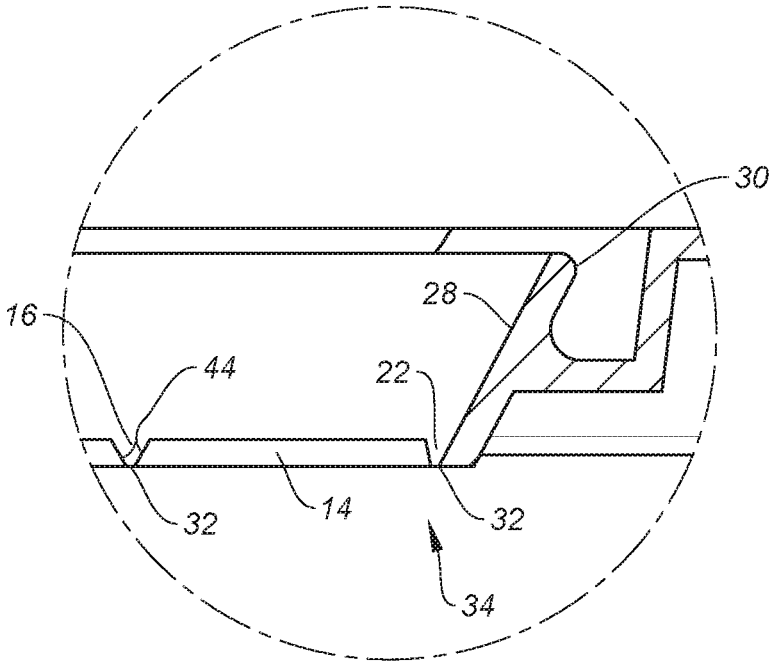
FIG. 5B is an enlarged view of FIG. 5A showing detail of the dispensing aperture.

Referring now to FIG. 5A, the canister lid 10 is shown in cross-section along with the aperture 12 and the diaphragm 14, one of the slits 16 and one of the additional slits 22. Referring to FIG. 5B, the indicated portion of FIG. 5A is shown in an enlarged manner. The diaphragm 14 is shown along with one slit 16 and one additional slit 22. In some embodiments, as shown in cross-section in FIG. 5B, a frustoconical section 28 of the aperture 12 is present. The frustoconical section 28 extends outwardly from the diaphragm 14 and may form a lip 30. Lip 30 acts as part of the snap fit arrangement with the cap 24. The slits 16, along with the additional slits 22 may touch at their lower edges 32, or they may be spaced apart depending on the characteristics of the sheet material being dispensed. In some embodiments both the substantially linear slits 16 and the additional slits 22 have cross sectional area that are smaller on one side and larger on another side. This is shown in FIG. 5B where the slit 16 is shown to have a "U" or "V" shaped groove having sloping sidewalls 44. In some embodiments the additional slit 22 may also have sloping sidewall 44 due to one side of the slit being smaller and another side being larger.

The aperture 12 includes two of the additional arcuate slits 22 located on opposite sides of the diaphragm 14 and substantially bisected by one of the substantially linear slits 16 adjacent to the outer edge 34 of the diaphragm 14.

The aperture 12 with the diaphragm 14 as set forth are formed in a lid 10 configured to form a snap fit with the container thereby allowing the container to be filled with the product 15 such as sheets or wipes 17 and then closed by the snap fit lid 10. Other connecting means include friction fits, press fits, and other mechanical closures such as those with male and female connectors, snaps, buttons, and the like.

The aperture 12 can be formed in part of the container and/or canister lid 10, and includes a diaphragm 14 portion, the aperture 12 having intersecting substantially linear slits 16 formed in the diaphragm 14 thereby forming a plurality of petals 18 in the diaphragm 14 where the slits 16 intersect, the aperture 12 further including at least one additional slit 22 in the diaphragm 14, the at least one additional slit 22 is located adjacent a peripheral portion 34 of the diaphragm 14 and is intersected by at least one of the linear slits 16, thereby increasing the flexibility of at least one of the petals 18 by reducing a length of edge thereof supported by the peripheral portion 34 of the diaphragm 14, thereby allowing substantially one sheet at a time to be pulled from the container 13.

Figure 6:
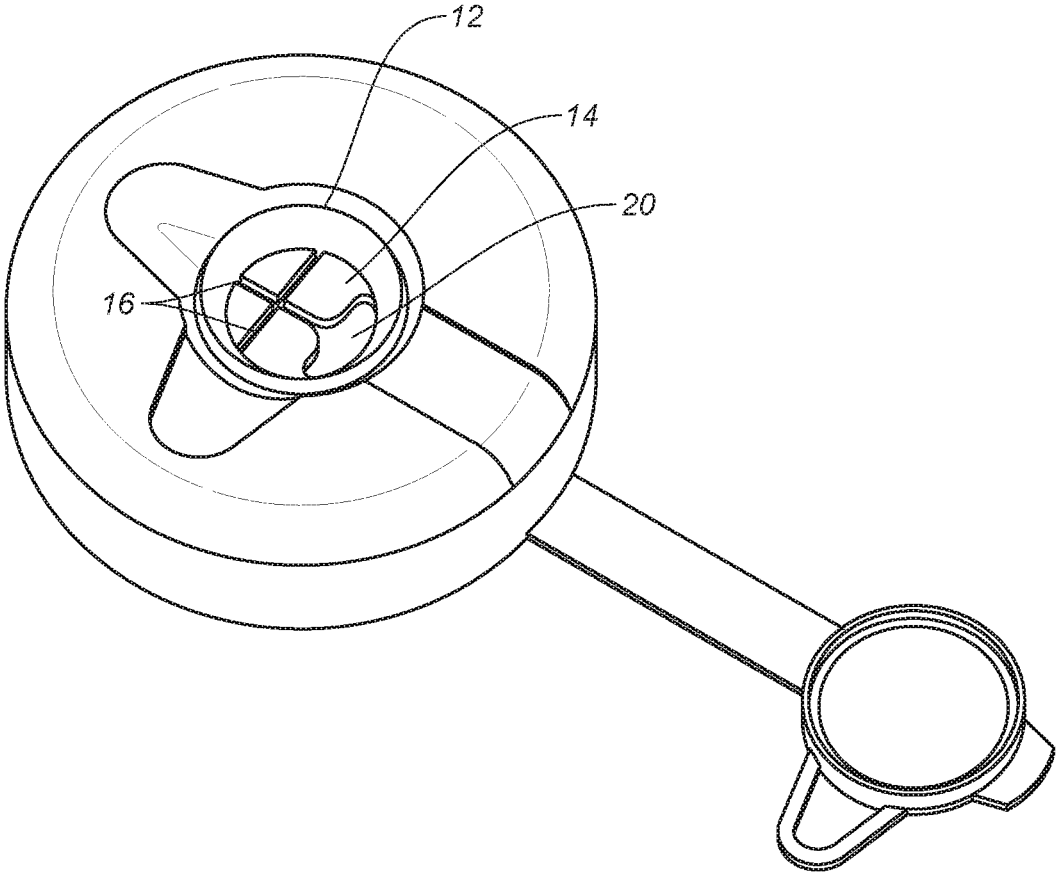
FIG. 6 is a pictorial view of another embodiment of the dispenser lid.

Referring now to FIG. 6, an alternative embodiment is shown. The aperture 12 includes the diaphragm 14. The diaphragm 14 includes the slits 16, but the slits 16 may be located off center from the center 60 of diaphragm 14. In addition, the opening 20 is formed in the diaphragm 14 and is greater in area than the additional slits 22.

Figure 7A:
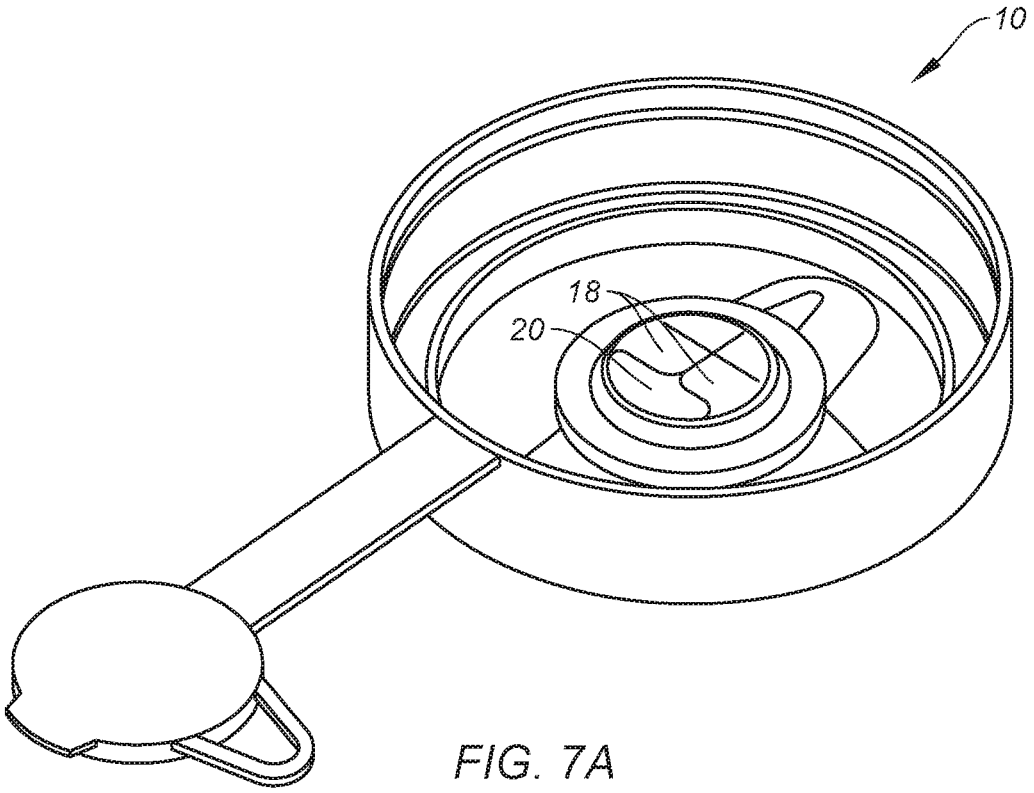
FIG. 7A is a pictorial view of the inside of the dispenser lid shown in FIG. 6.

Referring to FIG. 7A, the inside of canister lid 10 of the exemplary embodiment of FIG. 6 is shown. The inside of canister lid 10 shows the arrangement of the opening 20 as a larger opening than the additional slits 22 of previous embodiments. The aperture 12 is similar to previous embodiments, however, the petals 18 are different in size to each other. The larger opening 20 reduces the overall size of the larger openings 18 of this exemplary embodiment.

Figure 7B:
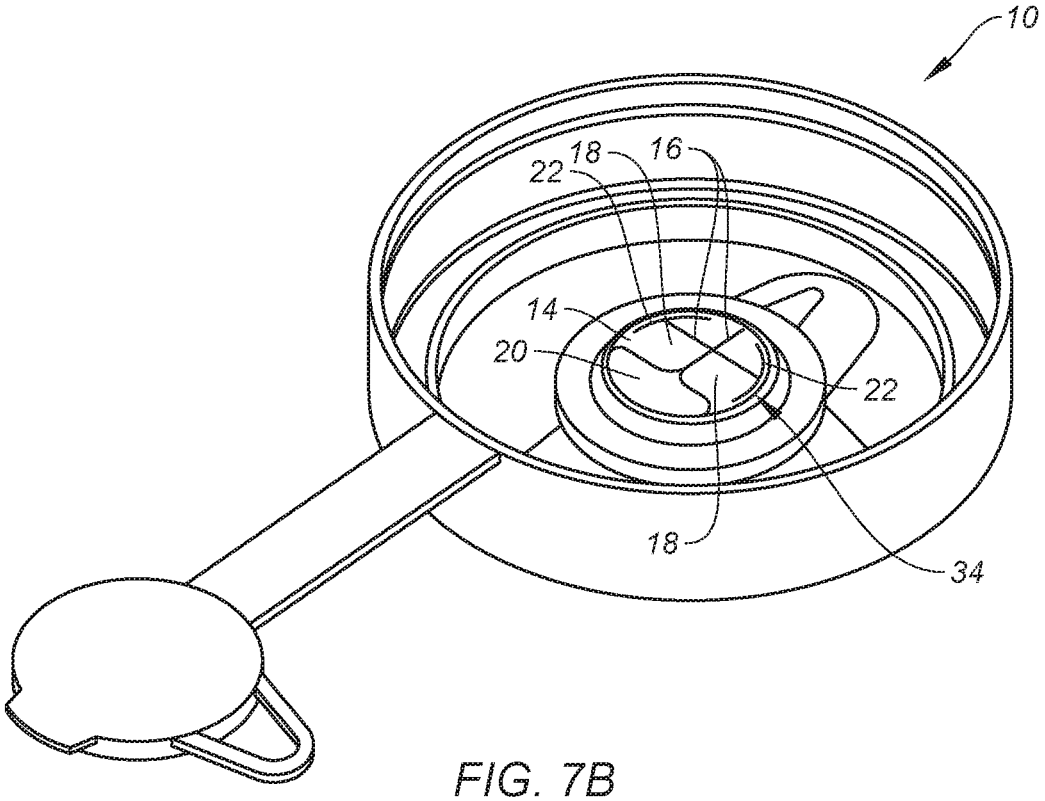
FIG. 7B is a pictorial view of the inside of the dispenser lid shown in FIG. 7A in yet another embodiment.

Referring to FIG. 7B, the inside of canister lid 10 of an alternative embodiment of FIG. 7A is shown. The inside of canister lid 10 shows the arrangement of the opening 20 as a larger opening than the additional slits 22 of previous embodiments. The aperture 12 is similar to previous embodiments, however, the petals 18 are different in size to each other. The larger opening 20 reduces the overall size of the larger openings 18 of this exemplary embodiment. In addition to the opening 20 shown in FIG. 7A, the opening here is sized and shaped to include an additional slit 22, as shown in FIG. 7B. In some embodiments, the additional slit 22 is arcuate in shape. As shown in FIG. 7B, two additional slits 22 are formed at or near both ends of one of the substantially linear slits 16. The additional slits 22 coincide with the arc of the diaphragm 14 when the diaphragm 14 is circular in cross-sectional shape. The additional slits 22 act to increase the flexibility of the diaphragm 14. The aperture 12, further includes at least one opening 20 in the diaphragm 14, and is intersected by at least one of the substantially linear slits 16, thereby increasing the flexibility of at least one of the petals 18 by reducing a length of edge thereof supported by the peripheral portion 34 of the diaphragm 14, thereby allowing substantially one sheet at a time to be more easily pulled from the container 13. In some embodiments, the number of slits 22 is between one and eight, depending on the number of petals 18, slits 16, and/or the contents being at least partially contained by canister lid 10 and/or being dispensed through such diaphragm 14.

Figure 8:
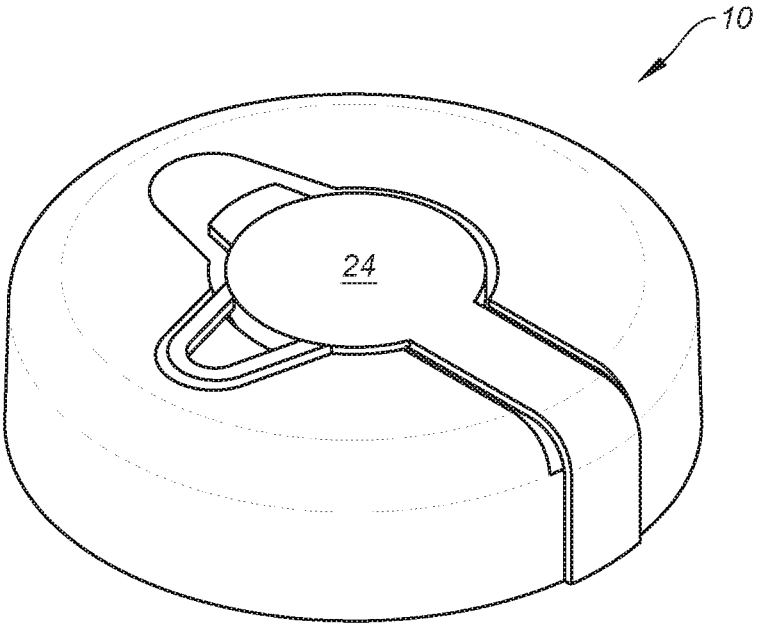
FIG. 8 is a pictorial view of the dispenser lid shown with a cap in a closed position.

Referring now to FIG. 8, the outside of canister lid 10 is shown. In the various embodiments, the canister lid 10 includes the cap 24 which may be attached to the canister lid via the strap 26. As shown in FIG. 8, the cap 24 is positioned for sealing the canister or container 13. As noted previously, the cap 24 may have a snap fit arrangement with canister lid 10 to help seal the aperture 12 from letting in outside air that might tend to dry out the sheet material if such is treated with a liquid.

Figure 9A:
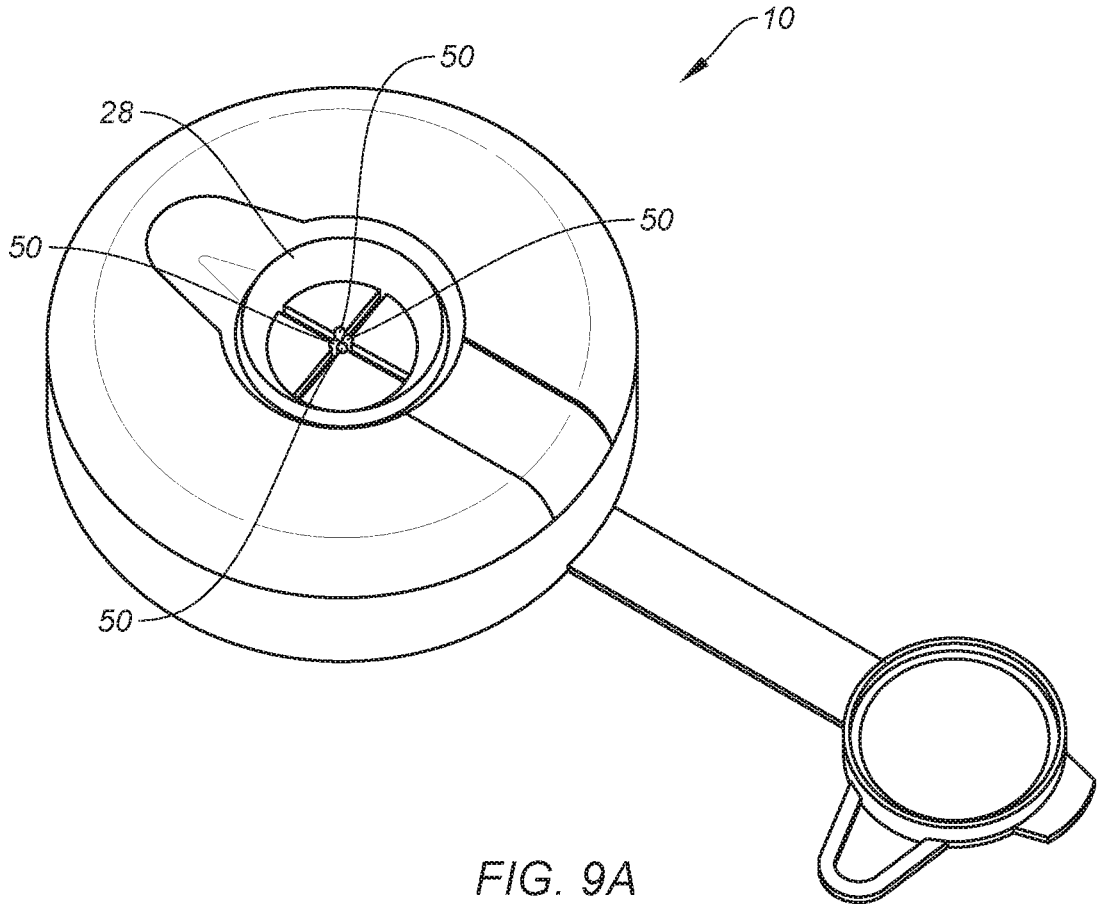
FIG. 9A is a perspective view showing an outside view of a dispenser lid with a dispensing aperture in still another embodiment.

Referring now to FIG. 9A, a canister lid 10 includes a frustoconical section 28 positioned around four petals 18 separated by the substantially linear slits 16. Each petal 18 has generally arcuate and/or hemispherical bubble 50 positioned at each inward-pointing corner of each petal 18, such that the bubbles are close to each other and close to the center of the frustoconical section 28. The bubbles 50 form a spacer to provide a gap between an inserted finger and the inward-pointing corners (tips). The space prevents direct contact between the finger and the corners which are sharp in some embodiments. In some embodiments, each bubble 50 is made of the same material as the petals 18, in other embodiments, bubbles 50 are made of a different polymeric material than the petals 18.

Figure 9B:
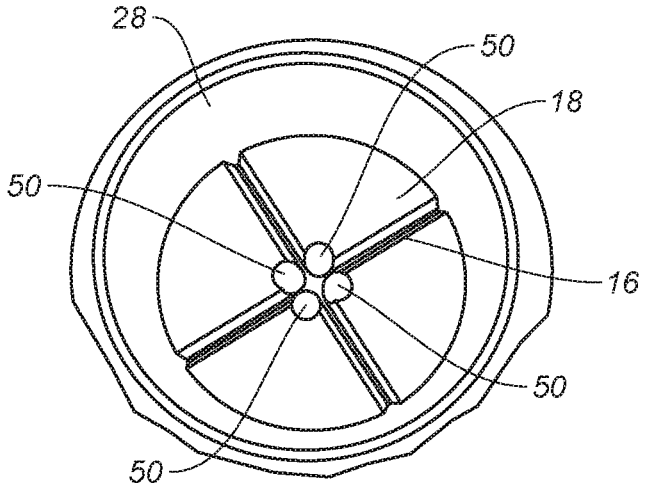
FIG. 9B is an enlarged sectional view of the dispensing aperture of FIG. 9A.

FIG. 9B is an enlarged sectional view of the dispensing aperture of FIG. 9A. The bubbles 50 are on an inside portion of the petals 18.

Figure 9C:
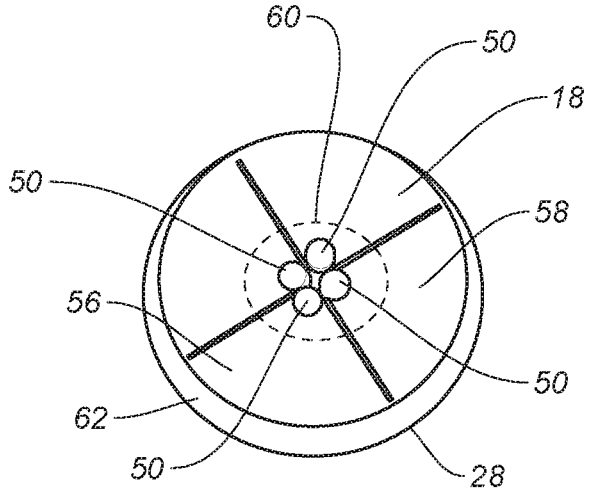
FIG. 9C is an enlarged sectional view of the dispensing aperture of FIG. 9A in even another alternative embodiment.

FIG. 9C is an enlarged sectional view of the dispensing aperture of FIG. 9A in even another alternative embodiment. Here the bubbles 50 are on an outside portion of the petals 18.

Figure 10A:
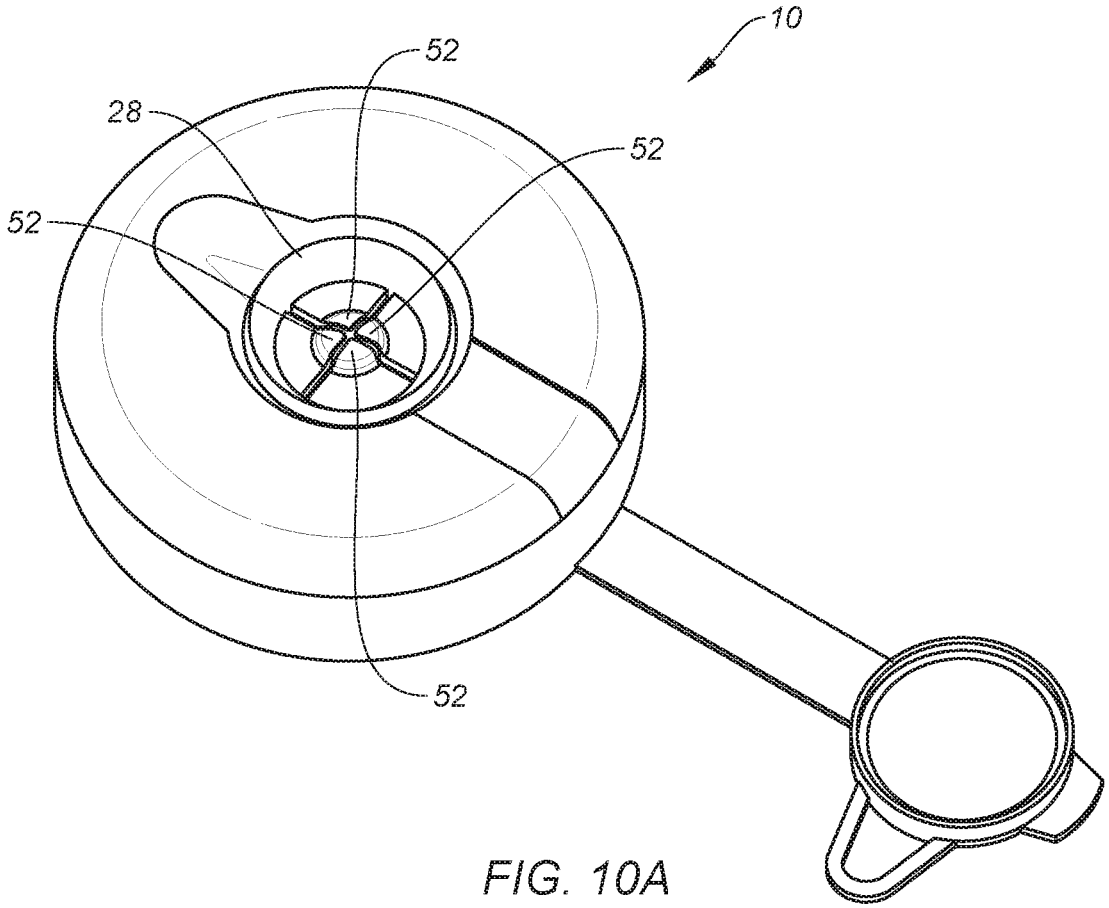
FIG. 10A is a perspective view showing an outside view of a dispenser lid with a dispensing aperture in yet even another embodiment.

Referring now to FIG. 10A, a canister lid 10 includes a frustoconical section 28 positioned around four petals 18 separated by the substantially linear slits 16. Each petal 18 has rounded coating 52 positioned at each inward-pointing corner of each petal 18, such that the rounded coatings are close to each other and close to the center of the frustoconical section 28. The inward-pointing corners (tips) are curved up and inwards. The inward-pointing corners (tips) are out of plane with the central region 58 and/or base region 56 such that inward-pointing corners (tips) are at an (a) elevated position with respect to central region 58 and/or base region 56, or (b) at an inferior position with respect to central region 58 and/or base region 56. The rounded coatings 52 form a spacer to provide a gap between an inserted finger and the inward-pointing corners. The space prevents direct contact between the finger and the corners which are sharp in some embodiments. In some embodiments, each rounded coating 52 is made of the same material as the petals 18, in other embodiments each rounded coating 52 is made of different polymeric material.

Figure 10B:
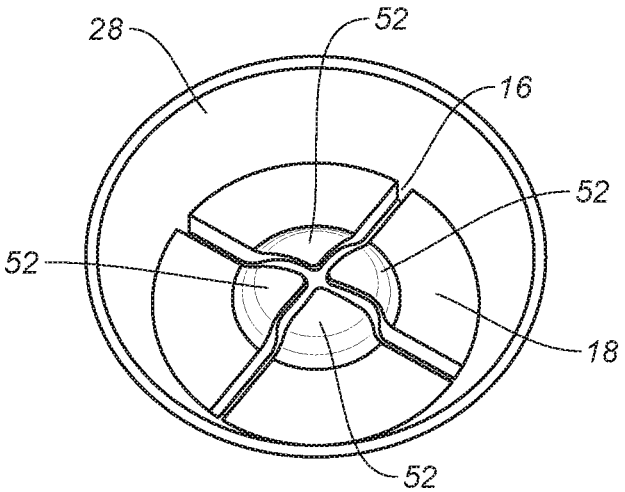
FIG. 10B is an enlarged sectional view of the dispensing aperture of FIG. 10A.

FIG. 10B is an enlarged sectional view of the dispensing aperture of FIG. 10A. The rounded coatings 52 are on an inside portion of the petals 18.

Figure 10C:
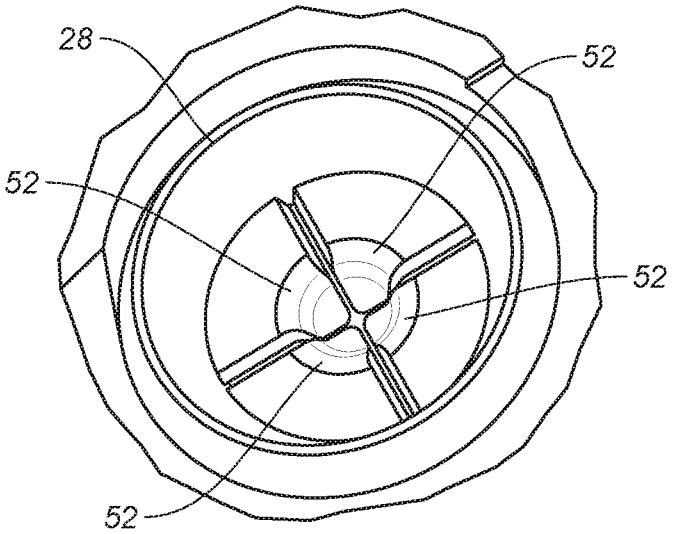
FIG. 10C is an enlarged sectional view of the dispensing aperture of FIG. 10A in yet still another alternative embodiment.

FIG. 10C is an enlarged sectional view of the dispensing aperture of FIG. 10A in even another alternative embodiment. Here the inward-pointing corners are curved down and inwards.

Referring now to FIG. HA, a canister lid 10 includes a frustoconical section 28 positioned around four petals 18 separated by the substantially linear slits 16. Each petal 18 has a rounded inward-pointing corner (tip) 54, such that the rounded inward-pointing corners are close to each other and close to the center of the fnistoconical section 28. The rounded inward-pointing corners 54 avoid having an inserted finger in contact with sharp corners because the rounded inward-pointing corners are not sharp due to significant rounding.

Figure 11A:
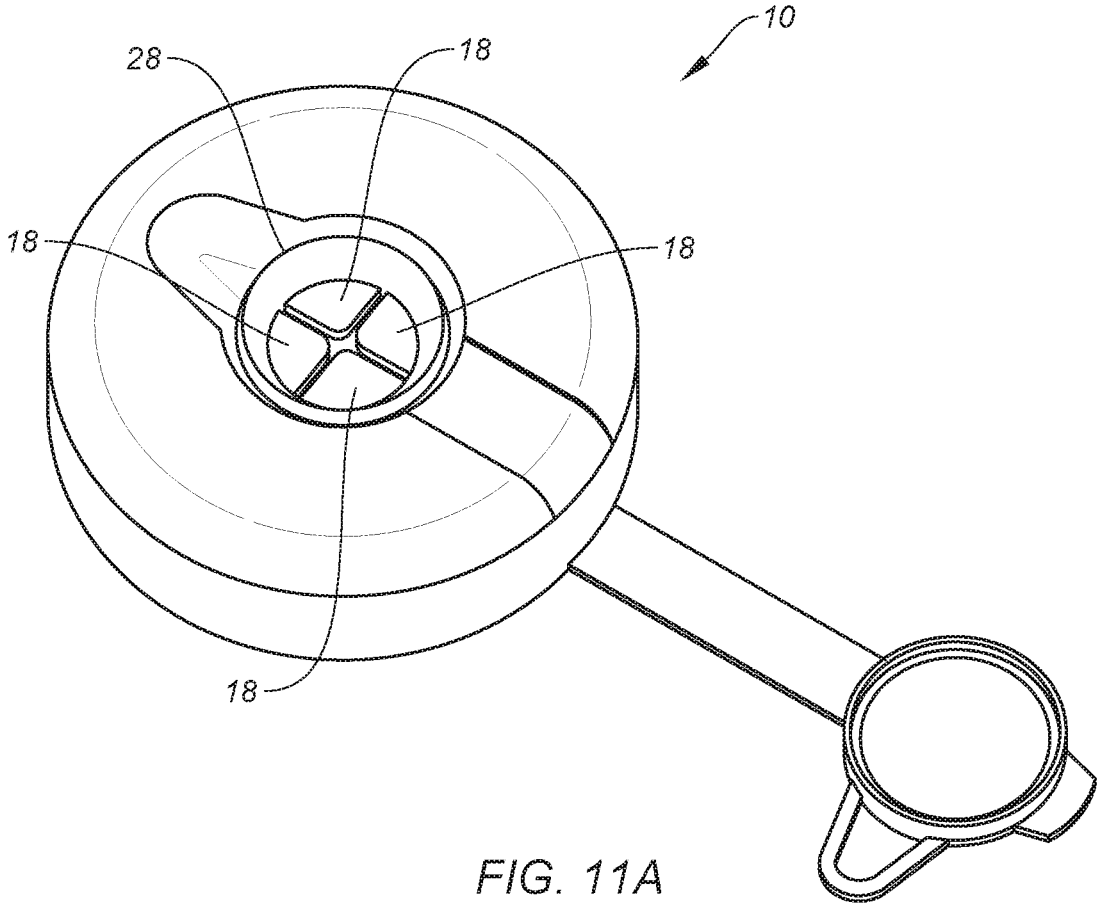
FIG. 11A is a perspective view showing an outside view of a dispenser lid with a dispensing aperture in still even another embodiment.
Figure 11B:
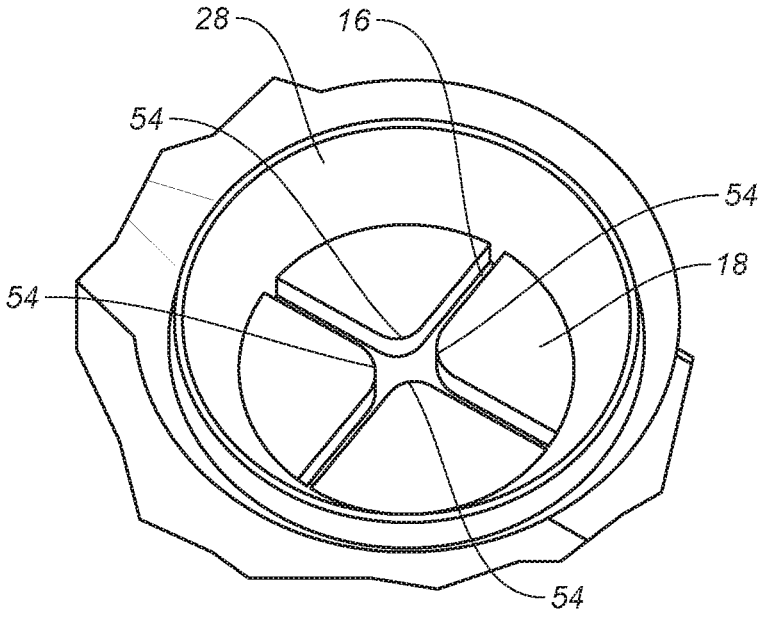
FIG. 11B is an enlarged sectional view of the dispensing aperture of FIG. 11A.

FIG. 11B is an enlarged sectional view of the dispensing aperture of FIG. 11A.

Figure 12:
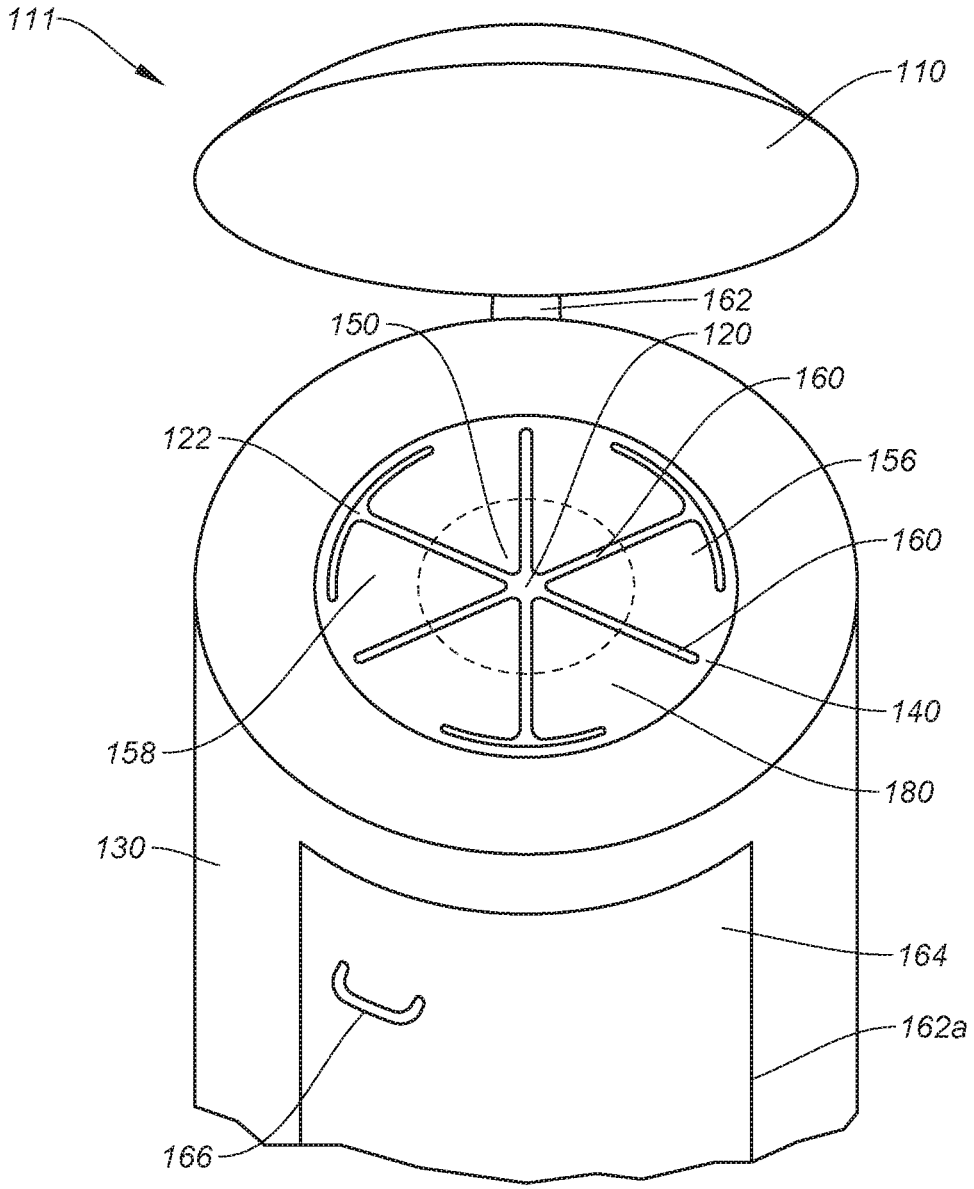
FIG. 12 is an angled sectional view of an aperture in still even another embodiment.

FIG. 12 exemplifies and additional embodiment of the present disclosure. A container assembly 111 has a diaphragm 140 including at least one petal 180. FIG. 12 demonstrates a six petal 180 configuration. Petals have base region 156, central region 158, and tip region 150. The diaphragm 140 includes a plurality of slits 160 that separate petals 180. The slits 160 are arcuate, but can be linear and/or further specific shapes such as an hourglass, ovular, etc. . . . . Aperture 120 defines a center opening within diaphragm 140. Slits 122 extend to the base region of at least one petal 180, thereby reducing the force required to deflect petals 180 and thus pass downward and upward through the diaphragm 140. Container assembly 111 has a lid 110 and a container 130. Lid 110 is movable with respect to the container 130 by hinge 162. Container assembly 111 is preferable for accessing container 130 to deposit products 150 into container 130 such that products 150 are stored within container 130. Products include snacks or small items for storage, but such containers 130 provide quick push-through access. Products also include waste products such as human waste, pet waste, pads, diapers, etc. . . . and such a container assembly 111 is a waste disposal device. For these embodiments, container 130 optionally has a door 164 facilitating removal of such waste when container 130 is full. Door 164 is movable with respect to container 130 via hinge 162*a*, and by using interaction feature 166 (i.e. a handle, button, lever, etc. . . . ). Container assembly 111 is configured to receive a length of liner material releasably securable to the container 130 such that product deposited within container 130 is within liner material.

Slits 122 assist in product 150 passing through diaphragm 140 and into container 130 by gravity, thereby reducing the amount of applied force by a user to the product 150 (i.e. waste). Similarly, removal of product 150 through diaphragm 140 is less abrasive and/or lead to less pinching of the user's finger(s) and/or hand. Likewise, removal of a user's finger(s) or hand through diaphragm 140 after depositing product 150 (i.e. snacks, other items, or waste) in container 130 is less abrasive and/or lead to less pinching of the user's finger(s) and/or hand.

Figure 13:
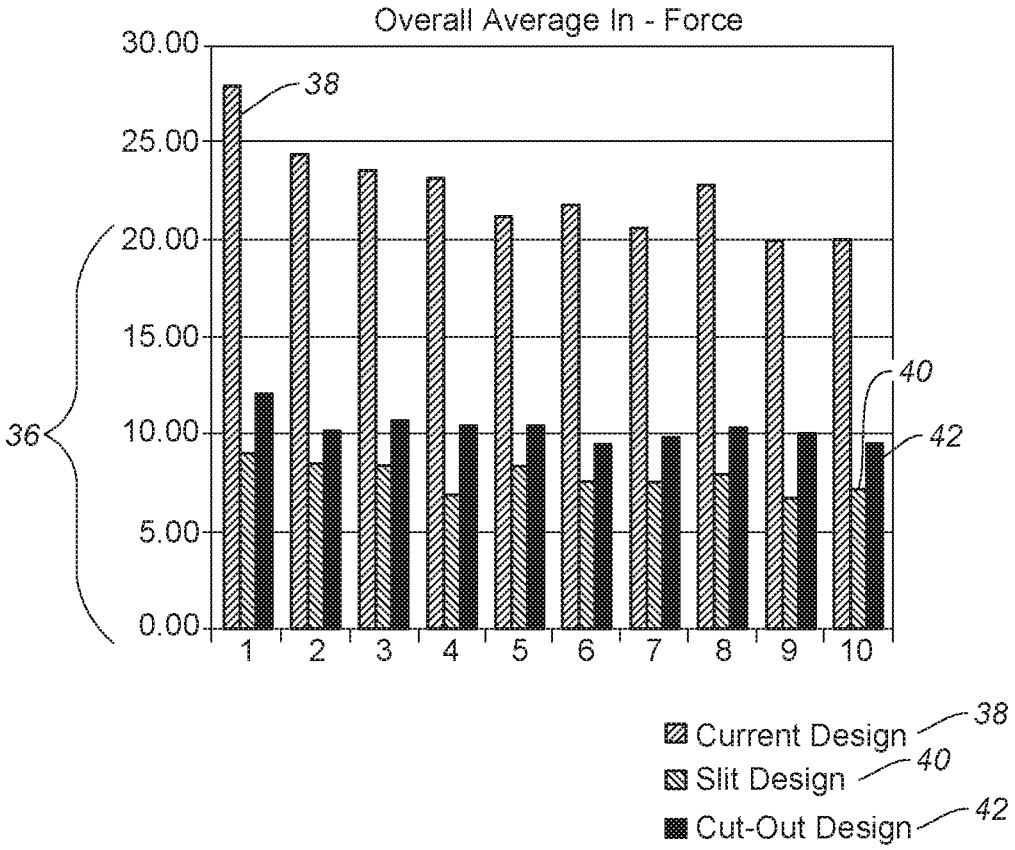
FIG. 13 is a graph showing the test results of the force required to insert a user's finger through the dispenser aperture in accordance with various exemplary embodiments.

FIG. 13 is a graph showing experimental data regarding a force (N) 36 required of a user to insert their finger through the aperture 12. The graph compares apertures of three embodiments, the prior art design 38, an embodiment having a slit design, and an embodiment having an opening design, for ten testers. The advantages of the embodiments disclosed herein are obvious in the reduction of force required to insert a finger through the aperture. Testing has shown that changes to the aperture design can adversely affect the dispensing of the wipes. Thus any improvement in the tendency of the aperture to pinch a user's fingers needs to be balanced with the ability of the aperture to dispense one wipe at a time, while also leaving a sufficient "tail" of the next wipe for pulling, thereby retaining the lid's functionality.

A separate test setup was used to measure tensile force by using a prosthetic finger physically coupled to a tensile testing machine. To measure the amount of tensile force required for a finger to be inserted and removed through a canister lid's opening, the prosthetic finger was used with a calibrated testing apparatus and slowly inserted and removed from the aperture as tensile measurements were being made. Standardized insertion and removal of the prosthetic finger into various embodiments described herein was used to confirm tensile force reduction efficacy as compared a prior aperture configuration.

The goal of an improved lid design is to reduce the amount of pressure exerted on fingers without negatively impacting dispensing performance. The aperture must function to include ease of dispensing while reducing or minimizing the number of times the users experience different dispensing failures such as: more than one wipe—when the wipe does not cut off at the perforation (also called roping); not having enough wipe to grab—when the end of the trailing wipe left in the dispensing orifice is too small to grasp comfortably; needing to restart the roll—when the trailing wipe does not pull through the dispensing opening with the lead wipe, and the user must start over (also called loose tails).

The relatively closed appearance of the lid 10 with the additional slits 22 help alleviate any concern about the wipes drying out.

In further embodiments and as exemplified in part by the figures, the petals can have varying thickness either radially or along the length of the petals. By varying the thickness of the petals and/or the length of slits, bending of the petals can be torsional as opposed to a more so linear bending (with petals having a more consistent cross-sectional thickness). In some embodiments, a base region that is thinner than the central region and/or tip region, in some embodiments, configured as a living hinge, assists in generating a bending profile more akin to that of a trap door. In other embodiments, a gradual change in thickness along the petal, widthwise/radially or lengthwise, such that the change is gradual amongst at least two regions of the petal (i.e. base region and central region, central region and tip region, or base region and tip region) can assist in biasing the petals towards an open and/or closed configuration (thereby reducing the amount of force required to access contents of the container, and/or potentially reducing pinch opportunities). These embodiments can augment the dimensions and overall size of the opening.

In yet other embodiments, the slits vary to accommodate preferred opening configurations and/or bending profiles to assist in accessing the contents of the container. For instance, a pattern of alternating shorter slits and longer slits amongst the petals varies deflection. To the extent the diaphragm is attached to a moving linkage or rotation mechanism, a torsional bending profile is advantageous as it could accommodate situationally improved access (i.e. depositing into or removing from the container) to the contents of the container.

In further embodiments, slit length and petal thickness vary. For instance, a first petal has a first slit with a first length, the first petal having a first thickness gradient, and a second petal has a second slit with a second length, the second petal having a second thickness gradient. In some of these embodiments, the first and/or second thickness gradient varies amongst the petal regions. The first and second thickness gradients are different, opposite, or the same. In some further embodiments, the first slit length is different than the second slit length. In other embodiments, the first slit length and the second slit length are substantially the same length, but the first and second thickness gradients are different or opposite. In further embodiments, the slit lengths and thickness gradients are complimentary (i.e. work together) such that they achieve an at least partially additive performance benefit, such as reducing the force required to access the contents of the container and/or reduce pinching. Alternatively, the slit lengths and thickness gradients counteract each other in order to balance several performance improvements. For instance, the slit length(s) is shorter while the thickness gradient is greater (and/or the thickness in a particular petal region is significantly thinner than in a different petal region). Variance and/or patterns among a third petal, fourth petal, fifth petal, sixth petal . . . and/or an nth petal (in addition to the first and second petals) are within the scope of the present disclosure.

Various modifications and adaptations to the foregoing exemplary embodiments may become apparent to those skilled in the relevant arts in view of the foregoing description, when read in conjunction with the accompanying drawings. However, any and all modifications will still fall within the scope of the non-limiting and exemplary embodiments.

Furthermore, some of the features of the various non-limiting and exemplary embodiments may be used to advantage without the corresponding use of other features. As such, the foregoing description should be considered as merely illustrative of the principles, teachings and exemplary embodiments, and not in limitation thereof.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A container, comprising:

a circular shaped diaphragm including a plurality of substantially linear slits, the linear slits defining a plurality of petals, wherein adjacent ones of the petals are separated from one another by at least one of the linear slits, the plurality of petals each having a pair of side edges each formed by at least one of the linear slits, the plurality of petals each comprising:

a base region disposed at a peripheral portion of the diaphragm;

a tip region distal to said base region, the tip regions of said plurality of petals cooperating to define an aperture towards a center region of said diaphragm, the aperture having a first state where each tip region is substantially parallel to a horizontal axis, and a second state where said petals are other than parallel to said horizontal axis, wherein said diaphragm is a deflectable material;

wherein said aperture has a larger size in said second state than said first state; and wherein said diaphragm includes at least one arcuately shaped additional slit disposed within the base region of two of said plurality of petals, wherein the at least one arcuately shaped additional slit is configured to facilitate deflection of said diaphragm;

wherein each of the plurality of petals has a side edge length that is greater than an arcuate slit length in each of the plurality of petals; and wherein an average insertion force is between 6 N and 9 N.

2. The container of claim 1, wherein the at least one arcuately shaped additional slit intersects at least one of the substantially linear slits.

3. The container of claim 2, wherein the arcuately shaped additional slit is shaped to match the circular shaped diaphragm.

4. The container of claim 1, wherein the at least one arcuately shaped slit and said plurality of substantially linear slits, form the aperture in the second state such that the aperture has an arcuate shape having at least two ends that are angled to each other.

5. The container of claim 1, wherein said arcuately shaped additional slit is disposed within the base region of each of a pair of contiguous said plurality of petals.

6. The container of claim 1, wherein the container further comprises a roll of wipes at least partially contained within the container, wherein an individual wipe is dispensed from the roll of wipes upwards through the diaphragm.

7. The container of claim 1, wherein said at least one arcuately shaped additional slit includes a first arcuately shaped additional slit disposed within the base region of a first of the plurality of petals, and a second arcuately shaped additional slit disposed within the base region of a second of the plurality of petals.

8. The container of claim 7, wherein the first arcuately shaped additional slit intersects a first of the substantially linear slits, and the second of the arcuately shaped additional slit intersects a second of the substantially linear slits.

9. The container of claim 8, wherein the first arcuately shaped additional slits is disposed on a first side of the diaphragm, and the second arcuately shaped additional slits is disposed on a second side of the diaphragm, wherein the second side of the diaphragm is opposite the first side.

10. The container of claim 9, wherein the first arcuately shaped additional slit and the second arcuately shaped additional slits each extend along a line concentric with the circular shaped diaphragm.

11. The container of claim 8, wherein the first arcuately shaped additional slit is disposed within the base region of the first of the plurality of petals and a third of the plurality of petals that is contiguous with the first of the plurality of petals.

12. The container of claim 11, wherein the second arcuately shaped additional slit is disposed within the base region of the second of the plurality of petals and a fourth of the plurality of petals that is contiguous with the second of the plurality of petals.

13. A container, comprising:

a circular shaped diaphragm including a plurality of substantially linear slits, the linear slits defining a plurality of petals, wherein adjacent ones of the petals are separated from one another by at least one of the linear slits, the plurality of petals each having a pair of side edges each formed by at least one of the linear slits, the plurality of petals each comprising:

a base region disposed at a peripheral portion of the diaphragm;

a tip region distal to said base region, the tip regions of said plurality of petals cooperating to define an aperture towards a center region of said diaphragm, the aperture having a first state where each tip region is substantially parallel to a horizontal axis, and a second state where said petals are other than parallel to said horizontal axis, wherein said diaphragm is a deflectable material;

wherein said aperture has a larger size in said second state than said first state; and wherein said diaphragm includes at least two arcuately shaped additional slits disposed within the base region of two of said plurality of petals, wherein the at least two arcuately shaped additional slits are configured to facilitate deflection of said diaphragm and intersect at least one of the substantially linear slits;

wherein each of the plurality of petals has a side edge length that is greater than an arcuate slit length in each of the plurality of petals; and wherein an average insertion force is between 6 N and 9 N.

14. The container of claim 13, wherein said at least two arcuately shaped additional slit includes a first arcuately shaped additional slit disposed within the base region of a first of the plurality of petals, and a second arcuately shaped additional slit disposed within the base region of a second of the plurality of petals.

15. The container of claim 13, wherein the at least two arcuately shaped slits and said plurality of substantially linear slits, form the aperture in the second state such that the aperture has an arcuate shape having at least two ends that are angled to each other.

16. The container of claim 13, wherein the first arcuately shaped additional slit intersects a first of the substantially linear slits, and the second of the arcuately shaped additional slit intersects a second of the substantially linear slits.

17. The container of claim 16, wherein the first arcuately shaped additional slits is disposed on a first side of the diaphragm, and the second arcuately shaped additional slits is disposed on a second side of the diaphragm, wherein the second side of the diaphragm is opposite the first side.

18. The container of claim 17, wherein the first arcuately shaped additional slit is disposed within the base region of the first of the plurality of petals and a third of the plurality of petals that is contiguous with the first of the plurality of petals.

19. The container of claim 18, wherein the second arcuately shaped additional slit is disposed within the base region of the second of the plurality of petals and a fourth of the plurality of petals that is contiguous with the second of the plurality of petals.

* * * * *